US007659867B2

(12) United States Patent
Hasegawa et al.

(10) Patent No.: US 7,659,867 B2
(45) Date of Patent: Feb. 9, 2010

(54) COMPLEX ANTENNA

(75) Inventors: Minoru Hasegawa, Yokohama (JP); Takao Shimamori, Yokohama (JP)

(73) Assignee: Samsung Electronics Co., Ltd. (KR)

( * ) Notice: Subject to any disclaimer, the term of this patent is extended or adjusted under 35 U.S.C. 154(b) by 449 days.

(21) Appl. No.: 11/641,157

(22) Filed: Dec. 19, 2006

(65) Prior Publication Data

US 2007/0139293 A1 Jun. 21, 2007

(30) Foreign Application Priority Data

Dec. 19, 2005 (JP) ..... 2005-364743
Aug. 21, 2006 (KR) ..... 10-2006-0078912

(51) Int. Cl.
*H01Q 1/36* (2006.01)

(52) U.S. Cl. ..... 343/895; 343/876

(58) Field of Classification Search ..... 343/876, 343/895

See application file for complete search history.

(56) References Cited

U.S. PATENT DOCUMENTS 5,594,461 A * 1/1997 O'Neill, Jr. ..... 343/895
5,896,113 A * 4/1999 O'Neill, Jr. ..... 343/895
6,094,178 A * 7/2000 Sanford ..... 343/895
6,339,408 B1 * 1/2002 Edvardsson et al. ..... 343/895
6,433,755 B1 * 8/2002 Kuramoto ..... 343/895

FOREIGN PATENT DOCUMENTS

JP 2003-314312 10/2005

OTHER PUBLICATIONS

Patent Abstracts Of Japan, Publication No. 2002-314312, Oct. 25, 2002.

* cited by examiner

*Primary Examiner*—Michael C Wimer
(74) *Attorney, Agent, or Firm*—NSIP Law

(57) ABSTRACT

Provided is a complex antenna which corresponds to both a circularly polarized wave and a linearly polarized wave. The complex antenna includes a substrate, a power feed terminal, four helical antenna devices disposed on the substrate at intervals of 90 degrees, four delay lines having different lengths by a quarter wavelength, and four switch modules which are connected to the power feed terminal in common and each of which is connected to each helical antenna device and each delay line. Each switch module selects one of a first mode in which the power feed terminal and each helical antenna device are directly connected and a second mode in which each delay line is connected to each helical antenna device so that a phase of a power feed fed from the power feed terminal and propagated from each delay line to each helical antenna device can be sequentially shifted by 90 degrees.

20 Claims, 7 Drawing Sheets

IN THE CASE OF LINEARLY POLARIZED WAVE

IN THE CASE OF CIRCULARLY POLARIZED WAVE

COMPLEX ANTENNA

PRIORITY

This application claims the benefit of Japanese Patent Application No. 2005-364743, filed on Dec. 19, 2005, in the Japanese Intellectual Property Office, and Korean Patent Application No. 10-2006-0078912, filed on Aug. 21, 2006, in the Korean Intellectual Property Office, the contents of both of which are incorporated herein by reference.

BACKGROUND OF THE INVENTION

1. Field of the Invention

The present invention relates generally to a complex antenna, and more particularly, to a complex antenna which corresponds to both a circularly polarized wave and a linearly polarized wave.

2. Description of the Related Art

Portable wireless devices which are capable of making communications using a satellite, such as Global Positioning Systems (GPS) phones and Personal Data Assistants (PDA), are increasingly popular and necessary. For example, there are safety advantages such as a user being able to immediately send exact position information obtained by using a GPS satellite to a police or fire station via a mobile phone base station in an emergency. In addition, satellite radio using a broadcasting satellite has good sound quality, many channels and a wide coverage area. Thus, a rapid proliferation of GPS or satellite radio is expected.

Antennas in which both ground communication and satellite communication are possible are needed in the above-described usages.

Since the GPS or satellite radio has circularly polarized waves, a patch antenna or a four-wire helical antenna is used therein. Since mobile phones or wireless Local Area Networks (LAN) have linearly polarized waves, a monopole antenna is used therein.

A technique of an antenna which corresponds to both a circularly polarized wave and a linearly polarized wave is disclosed in Japanese Patent Laid-open Publication No. 2002-314312. According to this disclosure, a monopole antenna is disposed in the vicinity of the center axis of a four-wire helical antenna and both of the antennas correspond to a circularly polarized wave and a linearly polarized wave. However, this combination causes a miniaturization effect, which is detrimental to the antenna performance.

SUMMARY OF THE INVENTION

The present invention provides a complex antenna which corresponds to both a circularly polarized wave and a linearly polarized wave.

According to the present invention, there is provided a complex antenna which includes a substrate, a power feed terminal provided at one side of the substrate, four helical antenna devices disposed on the substrate at intervals of 90 degrees centering on a first axis perpendicular to the substrate, four delay lines having different lengths by a quarter wavelength, and four switch modules which are connected to the power feed terminal in common and each of which is connected to each helical antenna device and each delay line, wherein each switch module selects one of a first mode in which the power feed terminal and each helical antenna device are directly connected and a second mode in which each delay line is connected to each helical antenna device so that a phase of a power feed fed from the power feed terminal and propagated from each delay line to each helical antenna device can be sequentially dislocated by 90 degrees.

BRIEF DESCRIPTION OF THE DRAWINGS

The above and other aspects of the present invention will become more apparent by a detailed description of the preferred embodiments thereof with reference to the attached drawings in which.

DETAILED DESCRIPTION OF THE PREFERRED EMBODIMENTS

Figure 1:
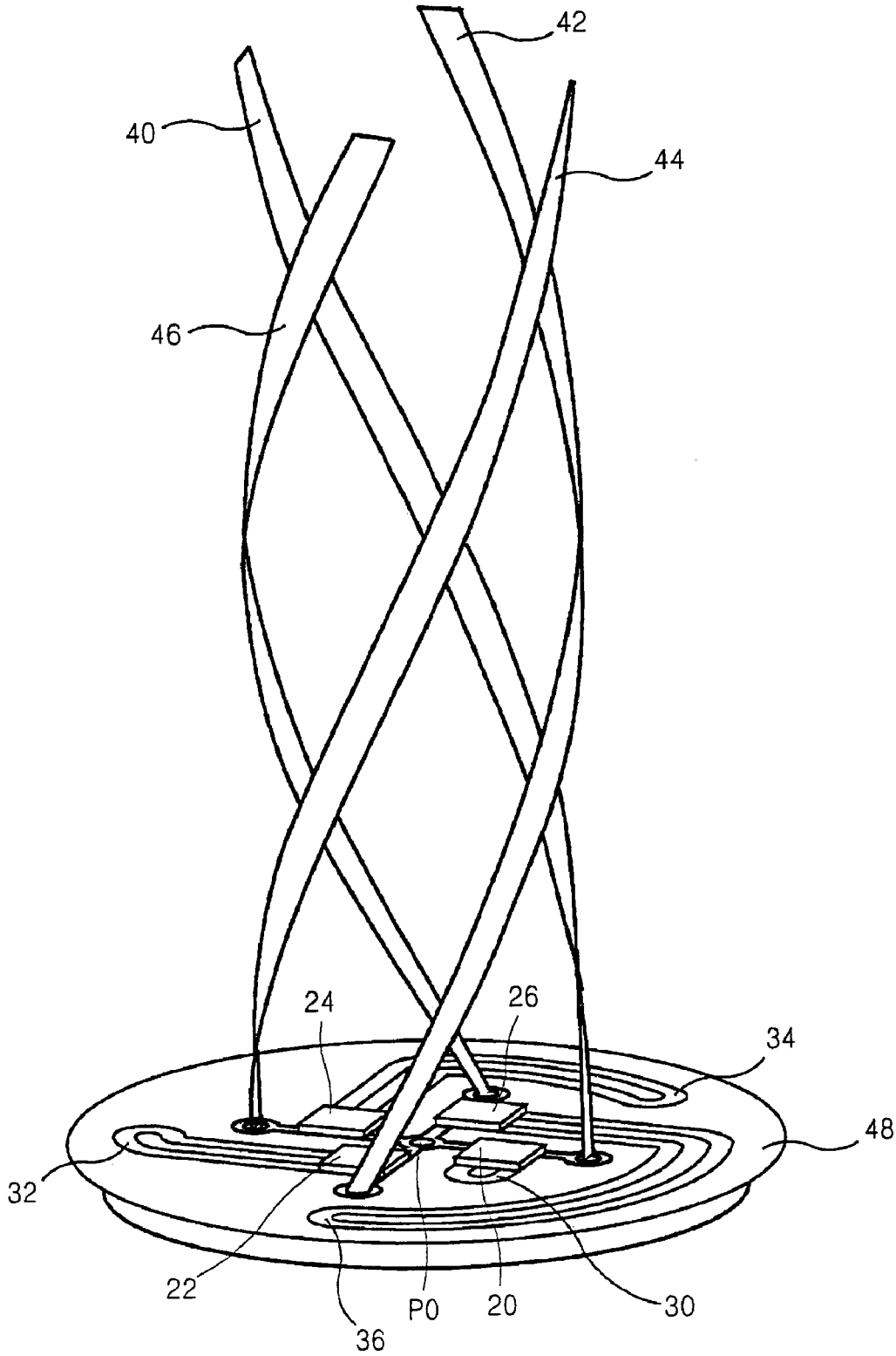
FIG. 1 is a perspective view of a complex antenna according to a first embodiment of the present invention.

Hereinafter, a preferred embodiment of the present invention will be described with reference to the accompanying drawings. It is to be noted that the same elements are indicated with the same reference numerals throughout the drawings. In the following description of the present invention, a detailed description of known functions and configurations incorporated herein will be omitted when it may obscure the subject matter of the present invention.

FIG. 1 is a perspective view of a complex antenna according to a first embodiment of the present invention. The complex antenna of FIG. 1 includes a PCB 48, a power feed terminal P0, first through fourth helical antenna devices 40, 42, 44 and 46, first through fourth switch modules 20, 22, 24 and 26 and first through fourth delay lines 30, 32, 34 and 36.

Each of the first through fourth helical antenna devices 40, 42, 44 and 46 includes conductors. The first through fourth helical antenna devices 40, 42, 44 and 46 extend spirally in a ceiling direction in which a pitch angle is preferably in the range of 30-60 degrees. Each of the first through fourth helical antenna devices 40, 42, 44, and 46 is disposed concentrically on the PCB 48 at intervals of 90 degrees. In addition, the first through fourth switch modules 20, 22, 24 and 26 and the first through fourth delay lines 30, 32, 34 and 36 are disposed on the PCB 48. The first through fourth switch modules 20, 22, 24 and 26 control a connection with the first through fourth delay lines 30, 32, 34 and 36.

Since the outer diameter, length and pitch angle of spirals of the first through fourth helical antenna devices 40, 42, 44 and 46 directly affect properties such as radiation patterns of an antenna or gains, the first through fourth helical antenna devices 40, 42, 44 and 46 can be properly designed according to requirements. A good conductor such as aluminum or copper alloy is used for the first through fourth helical antenna devices 40, 42, 44 and 46.

An antenna feed network which constitutes an electrical circuit between each of the first through fourth helical antenna devices 40, 42, 44 and 46 and the power feed terminal P0, is provided on the PCB 48. The first through fourth switch modules 20, 22, 24 and 26 which control a connection with each of the first through fourth delay lines 30, 32, 34 and 36, are disposed on the antenna feed network.

The antenna feed network may be provided on the PCB 48. Thus, the PCB 48 may be set to the size at which all of antenna feed networks can be installed. More preferably, the diameter of the PCB 48 is in the range of one time to three times of the outer diameter of a spiral of each of the first through fourth helical antenna devices 40, 42, 44 and 46.

Figure 2:
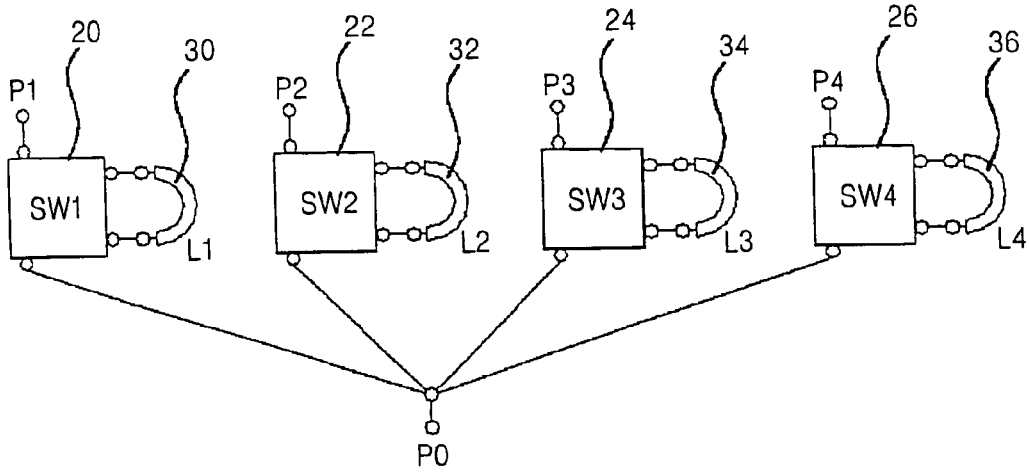
FIG. 2 is a view of an antenna feed network according to the present invention.

FIG. 2 is a view of an antenna feed network according to the present invention.

The first through fourth switch modules 20, 22, 24 and 26 which are provided between each of the first through fourth helical antenna devices 40, 42, 44 and 46 and the power feed terminal P0 and control connection with each of the first through fourth delay lines 30, 32, 34 and 36, are disposed on the antenna feed network.

The power feed terminal P0 is connected to a power feed unit (not shown) and a driving power is inputted to the power feed terminal P0. The length of the first delay line 30 is referred to as L1. The length L2 of the second delay line 32 is set to L1+λ/4, the length L3 of the third delay line 34 is set to L2+λ/4 and the length L4 of the fourth delay line is set to L3+λ/4, respectively. Here, λ is a wavelength on the first through fourth delay lines 30, 32, 34 and 36 of electromagnetic waves transmitted through the first through fourth delay lines 30, 32, 34 and 36.

First through fourth antenna terminals P1, P2, P3 and P4 are provided on the antenna feed network to be connected to arms of the first through fourth helical antenna devices 40, 42, 44 and 46. As a result, the power feed phases of the first through fourth helical antenna devices 40, 42, 44 and 46 to which power is fed via the first through fourth delay lines 30, 32, 34 and 36 are sequentially delayed at 90 degrees. A micro strip line may be used as the first through fourth delay lines 30, 32, 34 and 36.

Figure 3A:
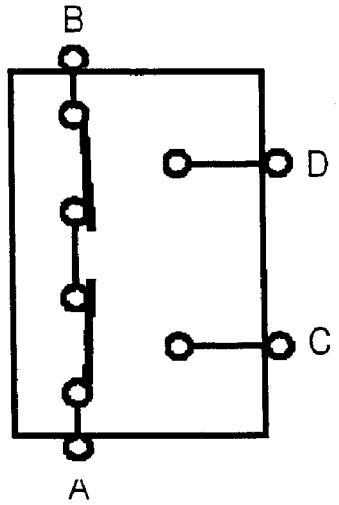
FIG. 3A is a view illustrating the state of a switch module in the case of a linearly polarized wave.
Figure 3B:
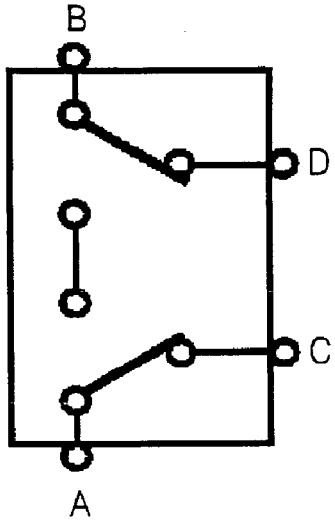
FIG. 3B is a view illustrating the state of a switch module in the case of a circularly polarized wave.

FIGS. 3A and 3B are views illustrating a first mode and a second mode respectively, switching states of the first through fourth switch modules 20, 22, 24 and 26.

First through fourth switch terminals A, B, C and D are provided on the first through fourth switch modules 20, 22, 24 and 26 and switched into one of the first mode and the second mode as illustrated in FIGS. 3A and 3B.

For example, the first switch terminal A is connected to the power feed terminal P0 by a wire on the PCB 48. The second switch terminal B is connected to each of the first through fourth antenna terminals P1, P2, P3 and P4 by wires on the PCB 48 and then is connected to each of the first through fourth helical antenna devices 40, 42, 44 and 46. The third switch terminal C is connected to one end of each of the first through fourth delay lines 30, 32, 34 and 36, and the fourth switch terminal D is connected to the other end of each of the first through fourth delay lines 30, 32, 34 and 36.

When transmitting and receiving a linearly polarized wave, the first through fourth switch modules 20, 22, 24 and 26 are switched into the first mode. That is, a circuit to the first through fourth delay lines 30, 32, 34 and 36 is opened and the first through fourth helical antenna devices 40, 42, 44 and 46 are positioned on the same phase, as illustrated in FIG. 3A.

Meanwhile, when transmitting and receiving or only receiving a circularly polarized wave, the first through fourth switch modules 20, 22, 24 and 26 are switched into the second mode and a phase of each helical antenna device is shifted by 90 degrees. The lengths of the first through fourth delay lines 30, 32, 34 and 36 are increased by a quarter wavelength from the first antenna terminal P1 to the fourth antenna terminal P4. In this case, the first through fourth switch modules 20, 22, 24 and 26 are converted, as illustrated in FIG. 3B, so as to connect the power feed terminal P0 to one end of the first through fourth delay lines 30, 32, 34 and 36. Similarly, the first through fourth switch modules 20, 22, 24 and 26 are converted, as illustrated in FIG. 3B, so as to connect the first through fourth antenna terminals P1, P2, P3 and P4 to the other end of each of the first through fourth delay lines 30, 32, 34 and 36. PIN structure semiconductor devices may be used as the first through fourth switch modules 20, 22, 24 and 26.

Table 1 shows power feed phases of the first through fourth antenna terminals P1, P2, P3 and P4 in the cases of a linearly polarized wave and a circularly polarized wave, respectively. When the linearly polarized wave is driven, the first through fourth antenna terminals P1, P2, P3 and P4 are positioned on the same phase a (degrees). When the circularly polarized wave is driven and the phase of the first antenna device P1 is β (degrees), the phase of the second antenna terminal P2 is β+90 (degrees), the phase of the third antenna terminal P3 is β+180 (degrees) and the phase of the fourth antenna terminal P4 is β+270 (degrees). In this case, all amplitudes of the first through fourth antenna terminals P1, P2, P3 and P4 are the same.

TABLE 1

| | Power feed phases (degrees) | | | |
|---|---|---|---|---|
| Power feed conditions | P1 | P2 | P3 | P4 |
| When linearly polarized wave is driven | α | α | α | α |
| When circularly polarized wave is driven | β | β + 90 | β + 180 | β + 270 |

In addition, when high precision is not required in amplitude and phase, the first switch module 20 and the first delay line 30 may be omitted. However, the first switch module 20 always connects the first delay line 30 having the length of 0, the power feed terminal P0 and the first antenna terminal P1. In addition, when high precision is required in amplitudes, an amplitude adjusting attenuator may be added to the first through fourth delay lines 30, 32, 34, 36.

Figure 4:
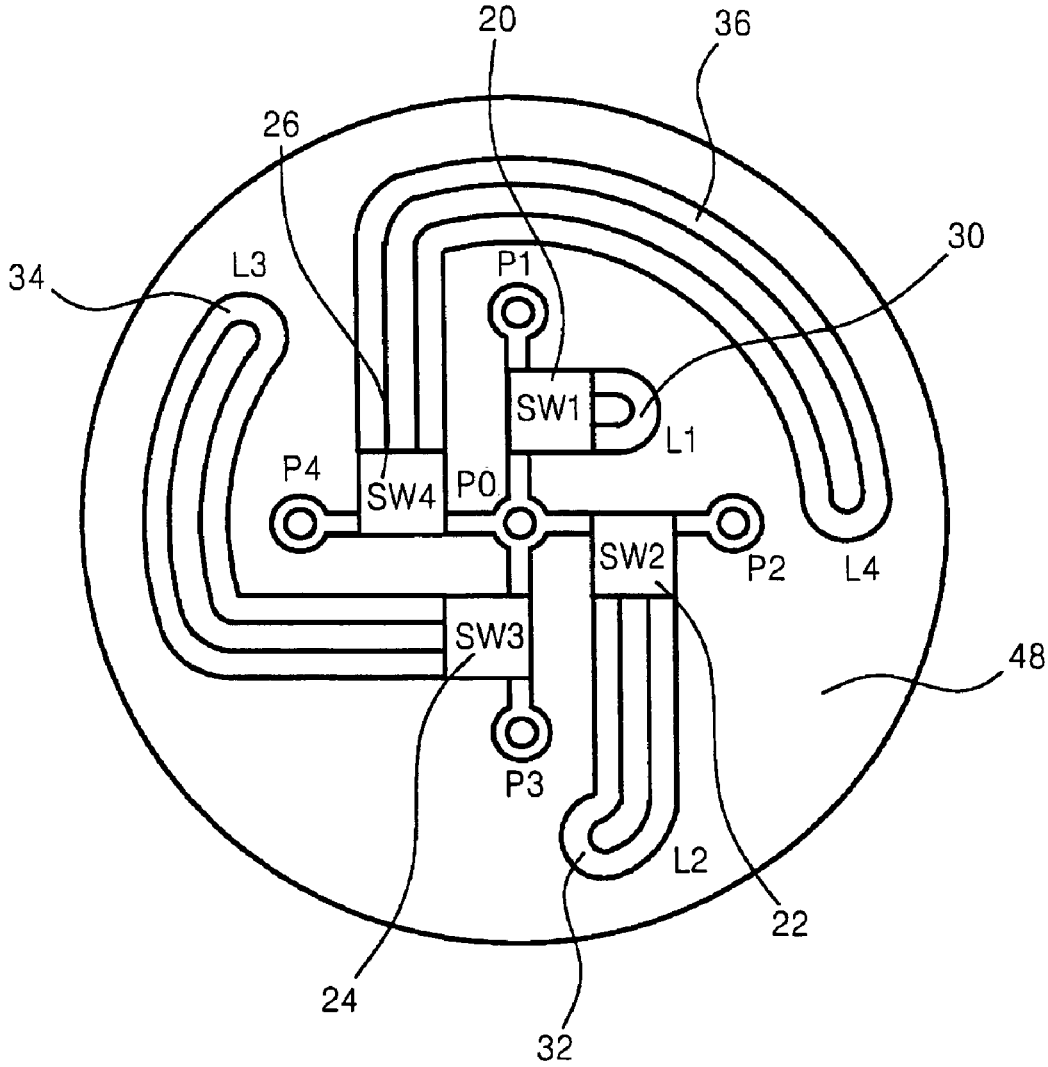
FIG. 4 is a plan view illustrating an arrangement design of a Printed Circuit Board (PCB) of the antenna feed network.

FIG. 4 is a plan view of the arrangement of the PCB 48. The power feed terminal P0 is disposed in the vicinity of a center of the PCB 48. The first through fourth antenna terminals P1, P2, P3 and P4 are disposed on a concentric circle centering on the power feed terminal P0 at about 90 degrees.

The first switch module 20 is disposed in the middle of the first through fourth antenna terminals P1, P2, P3 and P4, the first switch terminal A is connected to the power feed terminal P0, the second switch terminal B is connected to the first antenna terminal P1, the third switch terminal C is connected to one end of the first delay line 30 and the fourth switch terminal D is connected to the other end of the first delay line 30, respectively. Here, if the first through fourth delay lines 30, 32, 34 and 36 can be connected to the third switch terminal C and the fourth switch terminal D, the arrangement of the first through fourth delay lines 30, 32, 34 and 36 is not limited to the drawing. Hereinafter, the second switch module 22, the third switch module 24 and the fourth switch module 26 are disposed in the same manner.

Figure 5:
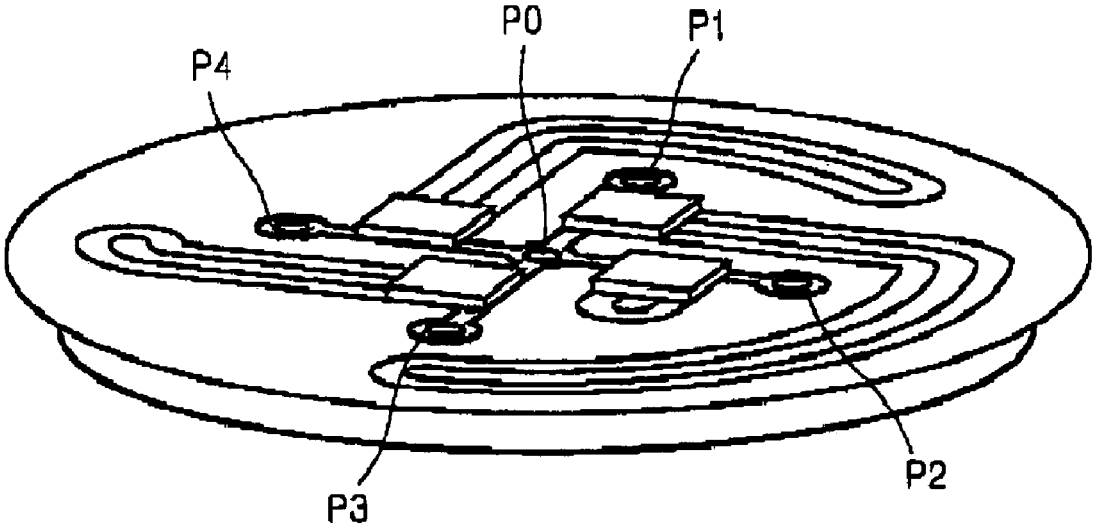
FIG. 5 is a perspective view of the PCB.

FIG. 5 is a perspective view of the PCB 48. Each of the first through fourth helical antenna devices 40, 42, 44 and 46 is connected to each of the first through fourth antenna terminals P1, P2, P3 and P4 of the PCB 48 to extend in a ceiling direction in a spiral shape, thereby constituting the complex antenna illustrated in FIG. 1. In the arrangement design of the PCB 48, the area of a circuit can be less than the half of the area of a construction of a conventional T-shaped distributor and a conventional delay line. Thus, the complex antenna can be made small.

In addition, the power feed terminal P0 is connected to a wireless system using a circularly polarized wave and a wireless system using a linearly polarized wave through a branching filter and a switch. By arranging such a front end at a rear surface of the PCB 48 (i.e., the antenna feed network), a more complex antenna can be made smaller.

The complex antenna having the above structure uses a helical antenna device for a circularly polarized wave and a helical antenna device for a linearly polarized wave in common. As a result, a monopole antenna does not need to be separately provided. In addition, even though the complex antenna has the same size as that of a conventional four-arm helical antenna, it corresponds to both a circularly polarized wave and a linearly polarized wave. Thus, miniaturization of the complex antenna can be implemented. Furthermore, one power feed terminal (i.e., an antenna input/output port) is provided as marked by reference numeral P0 of FIG. 1 so that a connection between the wireless system and the front end can be simplified and the complex antenna can be made smaller.

The helical antenna device illustrated in FIG. 1 is constructed, for example, of thin plate-shaped conductors. More preferably, the helical antenna device is formed of a good conductor and is not limited to the thin plate shape. A structure for winding a conductor around a cylindrical dielectric 50 is used to increase a mechanical strength.

Figure 6:
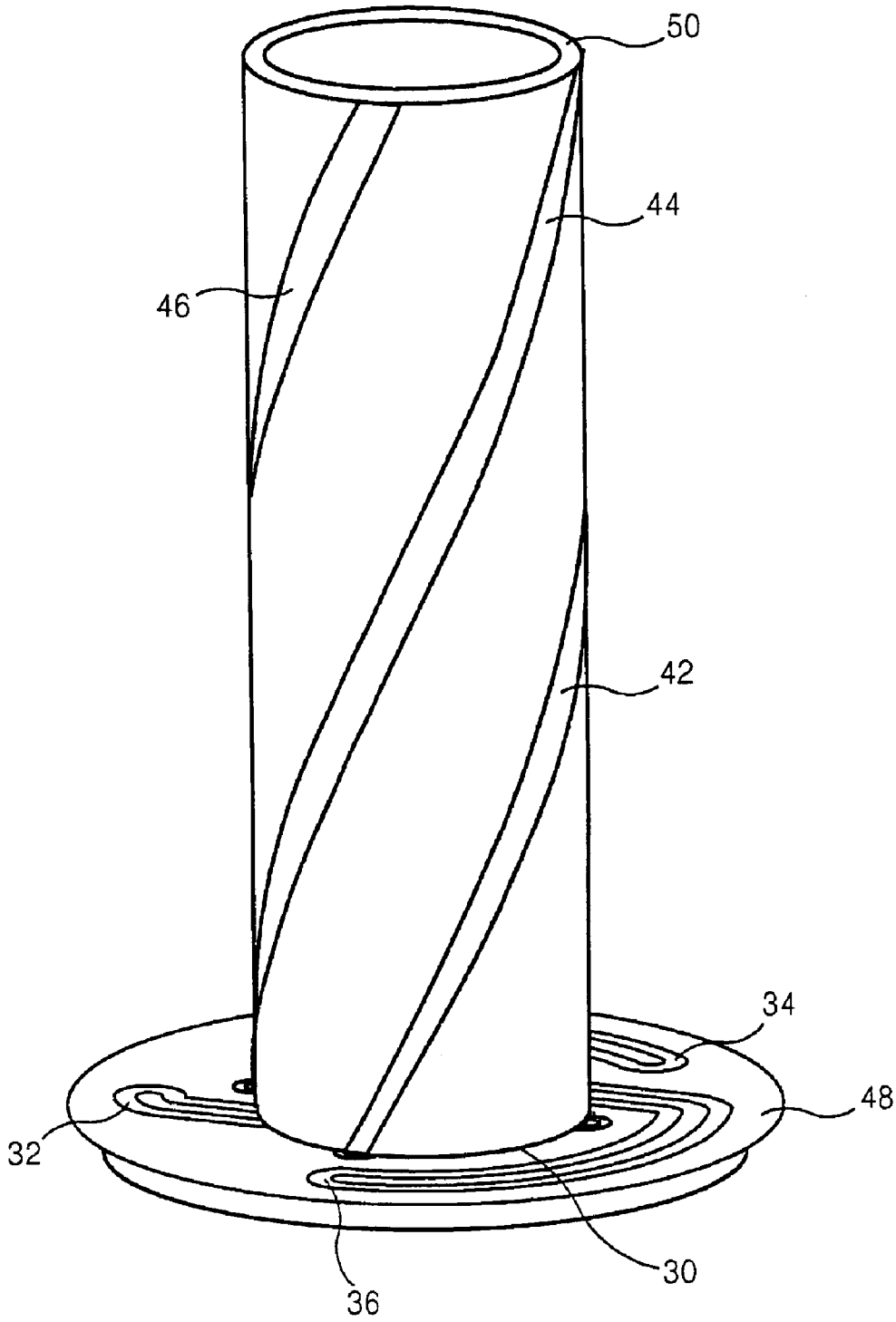
FIG. 6 is a perspective view of a complex antenna according to a second embodiment of the present invention.

FIG. 6 is a perspective view of a complex antenna according to a second embodiment of the present invention.

A conductor is wound around the cylindrical dielectric 50 at a pitch angle in the range of about 30-60 degrees. The cylindrical dielectric 50 is fixed on the PCB 48 so that the mechanical strengths of the first through fourth helical antenna devices 40, 42, 44 and 46 increase. In this case, if a groove is formed in advance on the surface of the cylindrical dielectric 50 as will be described later, the first through fourth helical antenna devices 40, 42, 44 and 46 can be more easily fixed on the PCB 48.

Meanwhile, as illustrated in FIG. 4, since the first through fourth switch modules 20, 22, 24 and 26 are disposed between the power feed terminal P0 and each of the first through fourth antenna terminals P1, P2, P3 and P4 and an end of a circumference of the cylindrical dielectric 50 is adjacent to the first through fourth antenna terminals P1, P2, P3 and P4, the first through fourth switch modules 20, 22, 24 and 26 are within the diameter of the cylindrical dielectric 50.

Figure 7:
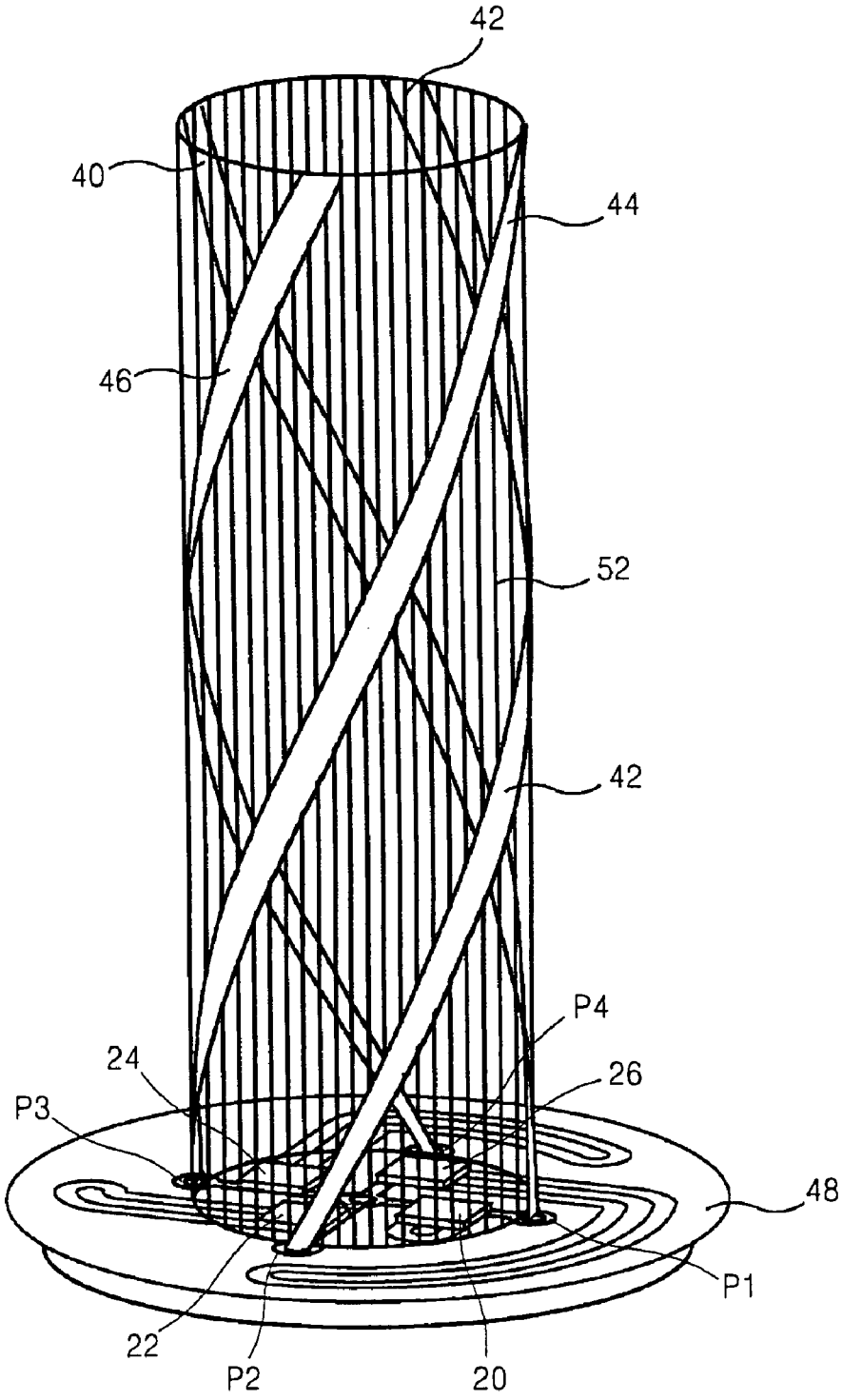
FIG. 7 is a perspective view of a complex antenna according to a third embodiment of the present invention.

FIG. 7 is a perspective view of a complex antenna according to a third embodiment of the present invention. The first through fourth helical antenna devices 40, 42, 44 and 46 are wound in a spiral shape around a support 52 which stands on the PCB 48. An insulator of the support 52 is formed in a mesh shape. In this case, the mesh pattern is not limited to the pattern illustrated in FIG. 1. The entire frame of the support 52 is cylindrical shaped. The first through fourth helical antenna devices 40, 42, 44 and 46 are supported by the support 52, so that the complex antenna has a light weight and an improved mechanical strength. The first through fourth switch modules 20, 22, 24 and 26 are disposed between the power feed terminal (P0 of FIG. 4) and each of the first through fourth antenna terminals P1, P2, P3 and P4 as shown in FIG. 6, and an end of a circumference of the support 52 is adjacent to the first through fourth antenna terminals P1, P2, P3 and P4, the first through fourth switch modules 20, 22, 24 and 26 are within the diameter of the support 52.

According to the first through third embodiments illustrated in FIGS. 1, 6 and 7, a connection with the four-wire helical antenna devices is converted by the switch modules such that it can be selected whether all of the power feed phases of the four-wire helical antenna devices are made the same or are dislocated at intervals of 90 degrees. When the power feed phases of the four-wire helical antenna devices are the same, transmission and reception of linearly polarized waves for a ground communication can be performed. Meanwhile, the power feed phases of the four-wire helical antenna devices are disclosed at intervals of 90 degrees such that reception (or transmission and reception) of circularly polarized waves for a satellite communication can be performed.

As described above, the complex antenna according to the present invention corresponds to both a circularly polarized wave and a linearly polarized wave. Four helical antenna devices are converted by four switch modules such that the complex antenna uses a helical antenna device for a linearly polarized wave and a helical antenna device for a circularly polarized wave in common and the complex antenna can be made small.

While this invention has been particularly shown and described with reference to preferred embodiments thereof, it will be understood by those skilled in the art that various changes in form and details may be made therein without departing from the spirit and scope of the invention as defined by the appended claims. The preferred embodiments should be considered in descriptive sense only and not for purposes of limitation. For example, even though the sizes, shapes, arrangement relationships and materials of elements such as antenna devices, switch modules, delay lines, a cylindrical dielectric, a support and a PCB which constitute the complex antenna, are designed by one of ordinary skilled in the art in various forms, they are included in the present invention as long as they are within the scope of the present invention.

What is claimed is:

1. A complex antenna comprising:

a substrate;

a power feed terminal provided at a side of the substrate;

four helical antenna devices disposed on the substrate at intervals of 90 degrees centering on a first axis perpendicular to the substrate;

four delay lines having lengths that differ from each other by a quarter wavelength; and four switch modules which are connected to the power feed terminal in common and each of which is connected to a respective helical antenna device and a respective delay line, wherein each switch module selects one of a first mode in which the power feed terminal and each helical antenna device are directly connected and a second mode in which each delay line is connected to each helical antenna device so that a phase of a power feed fed from the power feed terminal and propagated from each delay line to each helical antenna device is sequentially shifted by 90 degrees.

2. The complex antenna of claim 1, wherein a linearly polarized wave is transmitted or received in the first mode and a circularly polarized wave is transmitted or received in the second mode.

3. The complex antenna of claim 2, wherein each switch module comprises:

a first switch terminal connected to the power feed terminal, a second switch terminal connected to each helical antenna device, a third switch terminal connected to a first end of each delay line, and a fourth switch terminal connected to a second of each delay line, and further wherein the first switch terminal and the second end switch terminal are connected in the first mode, and concurrently, the first switch terminal and the third switch terminal are connected in the second mode and the second switch terminal and the fourth switch terminal are connected in the second mode.

4. The complex antenna of claim 1, wherein the delay lines are provided on the substrate.

5. The complex antenna of claim 1, wherein the switch modules are provided on the substrate.

6. The complex antenna of claim 1, wherein the helical antenna devices are thin plate-shaped conductors.

7. The complex antenna of claim 1, wherein an attenuator is connected to at least one delay line.

8. The complex antenna of claim 1, wherein a diameter of the substrate is in the range of one to three times of an outer diameter of a spiral formation of each helical antenna device.

9. The complex antenna of claim 1, further comprising a cylindrical dielectric, wherein each helical antenna device is wound around the dielectric in a spiral shape.

10. The complex antenna of claim 9, wherein each switch module is within a diameter of the dielectric.

11. The complex antenna of claim 9, wherein a linearly polarized wave is transmitted or received in the first mode and a circularly polarized wave is transmitted or received in the second mode.

12. The complex antenna of claim 11, wherein each switch module comprises:

a first switch terminal connected to the power feed terminal;

a second switch terminal connected to each helical antenna device;

a third switch terminal connected to a first end of each delay line; and a fourth switch terminal connected to a second end of each delay line, and further wherein the first switch terminal and the second switch terminal are connected in the first mode, and concurrently, the first switch terminal and the third switch terminal are connected in the second mode and the second switch terminal and the fourth switch terminal are connected in the second mode.

13. The complex antenna of claim 9, wherein an attenuator is connected to at least one delay line.

14. The complex antenna of claim 9, wherein a diameter of the substrate is in the range of one time to three times of an outer diameter of a spiral of each helical antenna device.

15. The complex antenna of claim 1, further comprising a cylindrical mesh support formed of an insulator, wherein each helical antenna device is wound around the mesh support.

16. The complex antenna of claim 15, wherein each switch module is accommodated in the mesh support.

17. The complex antenna of claim 15, wherein a linearly polarized wave is transmitted or received in the first mode and a circularly polarized wave is transmitted or received in the second mode.

18. The complex antenna of claim 17, wherein each switch module comprises:

a first switch terminal connected to the power feed terminal, a second switch terminal connected to each helical antenna device, a third switch terminal connected to one end of each delay line, and further wherein a fourth switch terminal connected to the other end of each delay line, and the first switch terminal and the second switch terminal are connected in the first mode, and concurrently, the first switch terminal and the third switch terminal are connected in the second mode and simultaneously, the second switch terminal and the fourth switch terminal are connected in the second mode.

19. The complex antenna of claim 15, wherein an attenuator is connected to at least one delay line.

20. The complex antenna of claim 15, wherein a diameter of the substrate is in the range of one time to three times of an outer diameter of a spiral formation of each helical antenna device.

* * * * *